US007833440B2

(12) United States Patent
Bessede et al.

(10) Patent No.: US 7,833,440 B2
(45) Date of Patent: Nov. 16, 2010

(54) HIGH PERFORMANCE DIELECTRIC OIL AND THE USE THEREOF IN HIGH VOLTAGE ELECTRICAL EQUIPMENT

(75) Inventors: Jean-Luc Bessede, Chateauvilain (FR); Christophe Perrier, Villeurbanne (FR); Abderrahmane Beroual, Champagne Au Mont d'Or (FR)

(73) Assignee: Areva T&D SA, Paris (FR)

( * ) Notice: Subject to any disclaimer, the term of this patent is extended or adjusted under 35 U.S.C. 154(b) by 1031 days.

(21) Appl. No.: 11/597,272

(22) PCT Filed: May 24, 2005

(86) PCT No.: PCT/FR2005/050356

§ 371 (c)(1),
(2), (4) Date: Nov. 20, 2006

(87) PCT Pub. No.: WO2005/119702

PCT Pub. Date: Dec. 15, 2005

(65) Prior Publication Data

US 2007/0222546 A1 Sep. 27, 2007

(30) Foreign Application Priority Data

May 28, 2004 (FR) ..... 04 51069

(51) Int. Cl.
*H01B 3/20* (2006.01)

(52) U.S. Cl. ..... 252/579; 252/567; 252/570

(58) Field of Classification Search ..... 252/579, 252/567, 570
See application file for complete search history.

(56) References Cited

U.S. PATENT DOCUMENTS

| | | | | |
|---|---|---|---|---|
| 2002/0017629 | A1 * | 2/2002 | Mosier et al. | 252/71 |
| 2003/0164479 | A1 * | 9/2003 | Goedde et al. | 252/570 |

FOREIGN PATENT DOCUMENTS

| | | |
|---|---|---|
| DE | 199 46 641 | 4/2000 |
| EP | 0 292 025 | 11/1988 |
| FR | 2 107 938 | 5/1972 |
| JP | 51063499 | 6/1976 |

OTHER PUBLICATIONS

CAS reg. No. 67254-74-4, Nov. 16, 1984.*

* cited by examiner

*Primary Examiner*—Douglas Mc Ginty
(74) *Attorney, Agent, or Firm*—Oblon, Spivak, McClelland, Maier & Neustadt, L.L.P.

(57) ABSTRACT

The invention relates to a high-performance dielectric oil comprising approximately 75 to 95% by volume of a naphthenic oil and approximately 5 to 25% by volume of an ester oil, in particular a synthetic ester oil and more preferably an oil of the family of polyolesters. The high-performance dielectric oil may be used in high-voltage electrical equipment such as power, measurement, distribution or traction transformers, tap changers, bushings, distributors, oil-immersed circuit breakers, power capacitors, cables, etc.

14 Claims, 3 Drawing Sheets

HIGH PERFORMANCE DIELECTRIC OIL AND THE USE THEREOF IN HIGH VOLTAGE ELECTRICAL EQUIPMENT

TECHNICAL FIELD

The present invention relates to a high-performance dielectric oil and to its use in high-voltage electrical equipment.

Such equipment may-especially be power, measurement, distribution or traction transformers, but also tap changers, bushings, distributors, oil-immersed circuit breakers, power capacitors or even cables.

PRIOR ART

Power transformers form part of the most strategic and most expensive components of electrical energy transmission and distribution networks. It is therefore essential that they operate correctly for as long as possible.

Most of these transformers are filled with a liquid that acts both as electrical insulate and as heat-transfer fluid. This liquid is almost always a mineral oil, coming from the fractional distillation of petroleum crudes. This preponderance of mineral oils is explained especially because of their low cost compared with that of synthetic insulating liquids that can be used in electrical engineering, such as alkylbenzenes. Ester and silicone oils are used in distribution transformers, but in power transformers they are rarely used, owing to their high cost.

Progress made in recent years in the materials field has allowed the dimensions of power transformers to be significantly reduced with, as consequences, a reduction in the size of the insulating ranges and an increase in the heat densities that need to be extracted.

The mineral oils present in these transformers are therefore required to exert their electrical insulation role within narrower ranges for equivalent, or even higher, operating voltages and at the same time to ensure the extraction of higher heat densities.

The fear is, although this has not been expressly demonstrated, that the use of mineral oils under these conditions will result in a failure of the transformers or else in a reduction in their lifetime, especially because of premature degradation of these oils.

The inventors were therefore set the objective of providing an oil that is of higher performance than the mineral oils currently used in power transformers, in particular in terms of dielectric strength and ageing resistance, so as to guarantee the operation of these transformers under the highest reliability and safety conditions, to give them a satisfactory lifetime and to offer the possibility of making them more compact.

The inventors were also set the objective of providing an oil which, while still having these advantages, has a manufacturing cost compatible with use in power transformers, given that a power transformer may contain more than 40 000 liters of oil.

SUMMARY OF THE INVENTION

This objective and other ones have been achieved by the invention, which proposes a dielectric oil comprising approximately 75 to 95% by volume of a naphthenic oil and approximately 5 to 25% by volume of an ester oil.

The inventors have in fact found that, surprisingly, the addition to a naphthenic oil in the proportions indicated above, results in a very pronounced improvement in the dielectric properties of this mineral oil, and also in its ageing resistance, without thereby affecting its viscosity and therefore its ability to ensure a heat transfer. It is thus obtained an oil having performances much higher than those of mineral oils which are conventionally used in power transformers, as well as those of silicone oils.

According to a first preferred embodiment of the invention, the naphthenic oil is an oil or a mixture of oils that has (have) an aromatic carbon content ($C_a$) of approximately 10 to 15%, a paraffinic carbon content ($C_p$) of approximately 40 to 45% and a naphthenic carbon content ($C_n$) of approximately 45 to 50%. As examples of naphthenic oils having this type of composition, mention may be made of the following oils: Nytro 10GBN, Nytro 3000 and Nytro 10X from Ninas; the oil Poweroil TO-10 from Apar; the oils Univolt 60 and Voltesso 35 from Esso; and the oils Diala A and Diala M from Shell.

According to the invention, the ester oil may be a plant-derived or synthetic oil, or a mixture of several plant-derived and/or synthetic oils. However, it is preferred to use a synthetic oil or a mixture of synthetic oils because these oils generally have a flow point below that of plant-derived oils and close to that of naphthenic mineral oils, so that they remain liquid at temperatures at which the plant-derived oils tend to solidify. In addition, synthetic ester oils oxide less rapidly than plant-derived ester oils.

According to another preferred embodiment of the invention, the ester oil is therefore a synthetic ester oil or a mixture of oils containing at least one synthetic ester oil.

Preferably, this synthetic ester oil is of the family of polyolesters and is more particularly an oil based on a pentaerythritol tetraester.

Advantageously, this oil based on a pentaerythritol tetraester satisfies the formula (I) below:

(I)

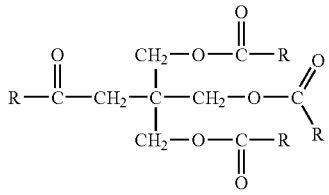

in which R represents an alkyl group ranging from $C_5H_{11}$ to $C_9H_{19}$. Such an oil is for example available from M&I under the brand name Midel 7131.

However, other ester oils may also be used, such as for example the synthetic oil ProEco TR3746 from Cognis or the synthetic oil Envirotemp 200 from CPS, or the plant-derived oils Biotemp from ABB or Envirotemp FR3 from CPS.

According to one particularly preferred arrangement of the invention, the dielectric oil comprises a naphthenic oil having an aromatic carbon content ($C_a$) of approximately 14%, a paraffinic carbon content ($C_p$) of approximately 41% and a naphthenic carbon content ($C_n$) of approximately 45%, and an oil based on a pentaerythritol tetraester satisfying formula (I) given above.

Preferably, the volume ratio of these two oils is 75/25 to 85/15, a volume ratio which is particularly preferred being approximately 80/20.

Apart from having the aforementioned advantages, the oil according to the invention also has that of being economically advantageous insofar as it consists mainly of mineral oil.

It is therefore particularly suitable for acting as an electrical insulant and heat-transfer fluid in high-voltage electrical equipment.

Within the context of the present invention, the term "high-voltage" is understood to mean any AC voltage of greater than 1000 V and any DC voltage of greater than 1500 V, in accordance with specifications of the International Electrotechnical Commission (IEC).

In particular, the oil according to the invention can be advantageously used in power, measurement, distribution or traction transformers, and especially in power distributors.

The invention will be better understood in the light of the rest of the description, which refers to an illustrative example of an oil according to the invention and to a demonstration of its properties.

Of course, this example is given merely by way of illustration of the subject matter of the invention and in no way constitutes any limitation of this subject matter.

DETAILED DESCRIPTION OF ONE PARTICULAR EMBODIMENT

Figure 1:
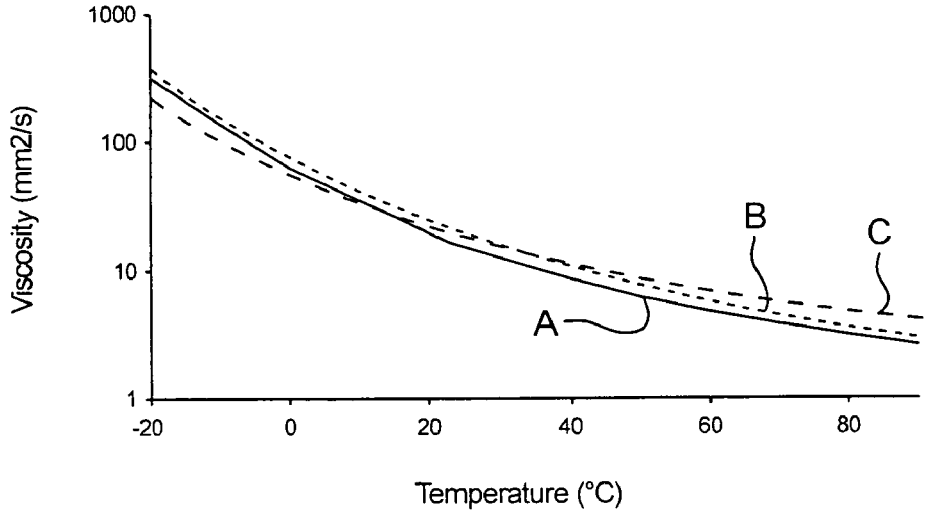
FIG. 1 shows the variation in viscosity (in $mm^2/s$) of a naphthenic oil (curve A), of an oil according to the invention composed of this naphthenic oil and of a synthetic ester oil in an 80/20 volume ratio (curve B), and of an oil composed of this same naphthenic oil and of a silicone oil in an 80/20 volume ratio (curve C) as a function of temperature (in ° C.).

An oil according to the invention was prepared by mixing:

* 80 parts by volume of the naphthenic oil sold by Nynas with the brand name Nytro 10GBN ($C_a$=14%; $C_p$=41%; $C_n$=45%); and
* 20 parts by volume of the pentaerythritol tetraester oil of formula (I) above, sold by M&I with the brand name Midel 7131;

until a homogeneous mixture was obtained.

The oil thus obtained was subjected to four series of tests intended to assess, respectively, the variation in its viscosity as a function of temperature, its dielectric strength, its ageing resistance and its tendency to become electrically charged.

For comparative purposes, the same four series of tests were carried out, on the one hand, on the Nynas naphthenic oil Nytro 10 GBN by itself and, on the other hand, on an oil consisting of a mixture of this same naphthenic oil and of the silicone oil Rhodorsil 604V50 (from Rhodia), also in an 80/20 volume ratio. These oils are denoted hereafter by "naphthenic oil" and "oil containing 20% silicone oil", respectively.

The tendency of the synthetic ester oil Midel 7131 by itself to become electrically charged was also tested. This oil is called hereafter "synthetic ester oil".

Viscosity Tests

The viscosity of the oils was determined according to the IEC 60296/ISO 3104 standard.

Dielectric Strength Tests

The dielectric strength of the oils was measured at room temperature according to the IEC 60156 standard, that is to say in an almost uniform electric field obtained with spherical electrodes, of horizontal axis. The inter-electrode space was set at 2.5±0.05 mm. The voltage was increased in a regular manner (2.0±0.2 kV/s) until breakdown, and each oil specimen tested was stirred-throughout the duration of the test.

Prior to each test, the oil specimens were filtered on a glass frit of 11 to 16 micron porosity, under a vacuum of $10^{-3}$ bar. Their water content was determined according to the IEC 60814 standard (Karl-Fischer coulometric titration); the number of particles was counted according to the IEC 60970 standard and the particulate contamination of the specimens was rated from 1 to 12 according to the German standard NAS 1638.

The breakdown voltages were measured by means of a Baur "dieltest" (100 kV/50 Hz) on 32 specimens for each oil tested and the measurements were analysed using the Laplace-Gauss law or the normal law, represented by the following formula:

$$f(x, u, \sigma)=[1/(\sqrt{2Pi}\ \sigma)].\exp-[(x-u)^2/2\sigma^2])$$

in which x represents the breakdown voltage (in kV), u represents the mean breakdown voltage (in kV) and σ represents the coefficient of variation.

The safety factor, which represents the minimum breakdown voltage of an oil, is determined for f(x,u,σ)=0.001, that is to say for a probability of 99.9%.

Ageing Tests

The ageing resistance of the -oils was determined according to the ASTM D1934-95 (2000) standard which proposes two oxidative ageing procedures, one without a metal catalyst and the other in the presence of a metal catalyst, namely a copper wire. In the latter procedure, to make the test more stringent than the ASTM D1934-95 (2000), (which recommends 15 $cm^2$ of copper per 300 ml of oil), we followed the recommendations of the IEC 61125 standard, (which recommends 9.7 $cm^2$ of copper per 25 g of oil), which represents 8.8% of the weight of the oil.

The ageing resistance of the oils was also tested after impregnation of Kraft paper and drying of the thus impregnated paper under conditions similar to those used for preparing oiled papers used in transformers.

In all cases, the ageing was carried out by leaving the specimens for 96 hours in an air circulation oven set at a temperature of 115° C.

The acidity and the dissipation factor (or tan δ) of the oils were measured before and after ageing.

Static Electrification Tests

The tendency of the oils to become electrically charged was assessed by means of a device called a "ministatic charge tester". This test consists in forcing the oil under test to pass through a filter consisting of a cellulose sheet, in order to cause charge separation. The charges remaining on the filter are measured using an electrometer and the results are expressed in terms of charge density, that is to say the amount of charge generated per unit volume of oil in the flow. The charge density is determined by the following formula:

$$\text{Charge density (in } \mu C/m^3) = (i.t.10^{12})/v$$

in which i represents the current (in amps), t represents the oil flow (in seconds) and v represents the oil volume (in ml).

Each oil was tested before and after filtration on a glass frit of 11 to 16 micron porosity, under a vacuum of $10^{-3}$ bar.

Results

Figure 2:
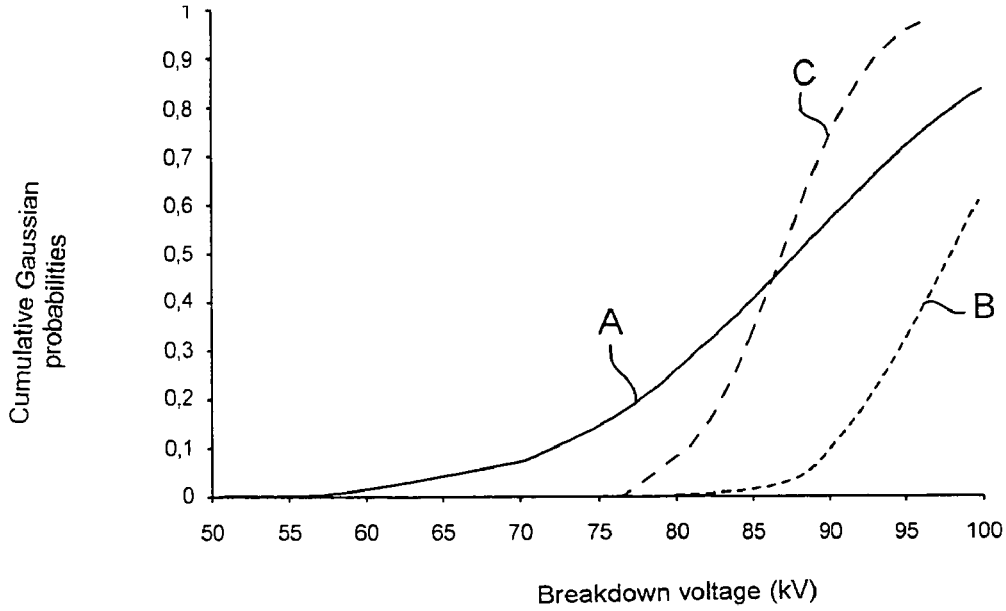
FIG. 2 shows the accumulative Gaussian probabilities of the occurrence of a breakdown in the case of a naphthenic oil (curve A), an oil according to the invention composed of this naphthenic oil and of a synthetic ester oil in an 80/20 volume ratio (curve B), and an oil composed of this same naphthenic oil and of a silicone oil in an 80/20 volume ratio (curve C).
Figure 3:
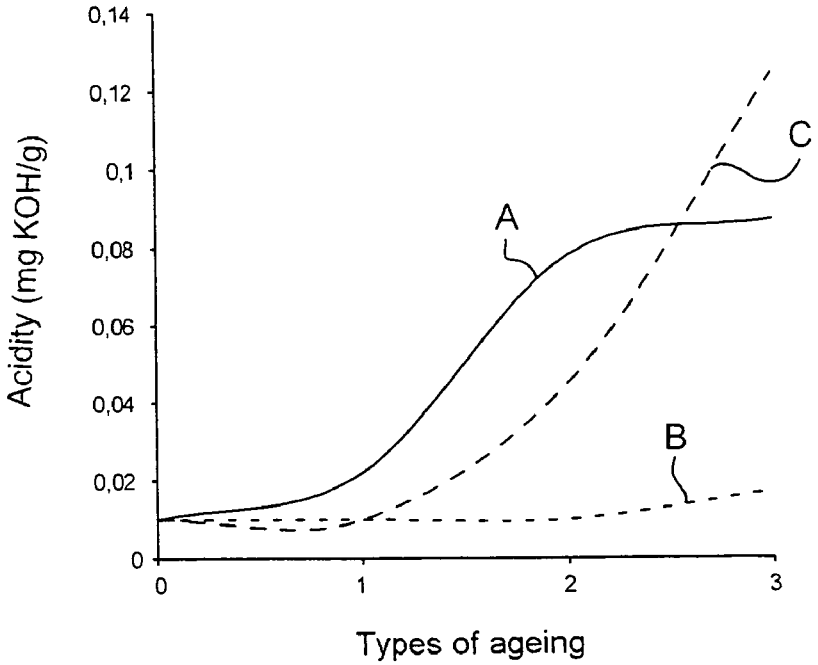
FIG. 3 shows the acidity (in mg of KOH/g of oil) of a naphthenic oil (curve A), an oil according to the invention composed of this naphthenic oil and of a synthetic ester oil in an 80/20 volume ratio (curve B), and an oil composed of this same naphthenic oil and of a silicone oil in an 80/20 volume ratio (curve C), before ageing (point 0 on the x-axis) and after ageing without a metal catalyst (point 1 on the x-axis), in the presence of a metal catalyst (point 2 on the x-axis), and in the presence of a cellulosic insulant called Kraft paper (point 3 on the x-axis).
Figure 4:
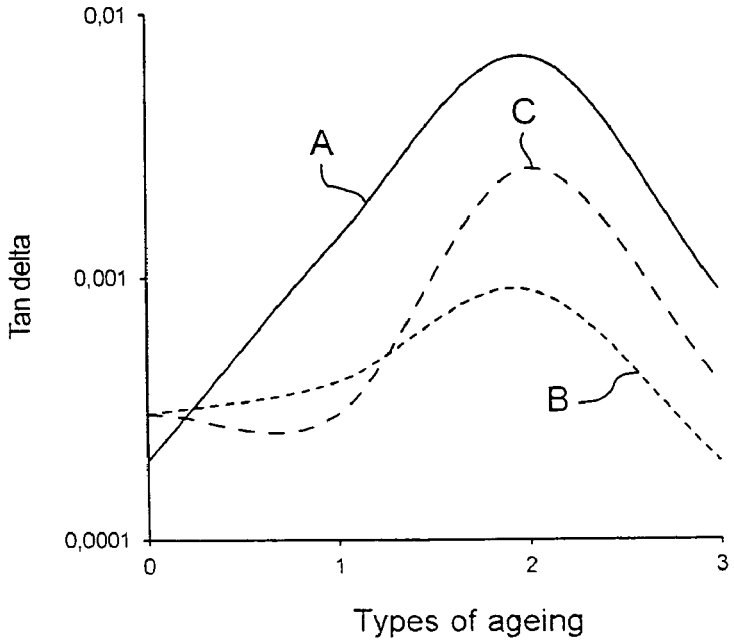
FIG. 4 shows the dissipation factor (or tan δ) of a naphthenic oil (curve A), an oil according to the invention comprising this naphthenic oil and a synthetic ester oil in an 80/20 volume ratio (curve B), and an oil composed of this same naphthenic oil and of a silicone oil in an 80/20 volume ratio (curve C), before ageing (point 0 on the x-axis) and after ageing without a metal catalyst (point 1 on the x-axis), in the presence of a metal catalyst (point 2 on the x-axis), and in the presence of a cellulosic insulant called Kraft paper (point 3 on the x-axis).
Figure 5:
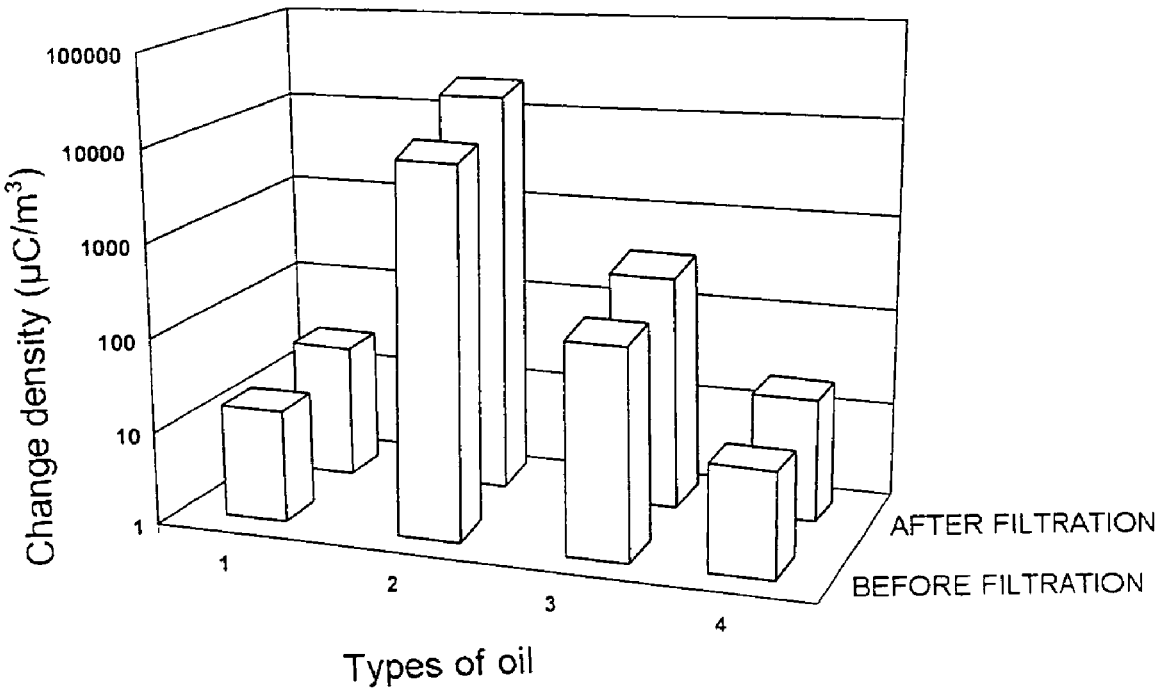
FIG. 5 shows the charge density of a naphthenic oil (point 1 on the x-axis), a synthetic ester oil (point 2 on the x-axis), an oil according to the invention composed of this naphthenic oil and of this synthetic ester oil in an 80/20 volume ratio (point 3 on the x-axis), and an oil composed of this same naphthenic oil and of a silicone oil in an 80/20 volume ratio (point 4 on the x-axis) before and after filtration, under a vacuum of $10^{-3}$ bar, on a glass frit of 11-16 micron porosity.

The results of the tests are illustrated in FIGS. 1 to 5, which show:

FIG. 1: the variation in viscosity, expressed in $mm^2/s$, of the naphthenic oil (curve A), the oil according to the invention (curve B) and the oil containing 20% silicone oil (curve C) as a function of temperature, expressed in ° C.;

FIG. 2: the cumulative Gaussian probabilities of the occurrence of a breakdown as obtained for the naphthenic oil (curve A), for the oil according to the invention (curve B) and for the oil containing 20% silicone oil (curve C);

FIG. 3: the acidity, expressed in mg of KOH/g of oil, of the naphthenic oil (A), the oil according to the invention (curve B) and the oil containing 20% silicone oil (curve C), before ageing (point 0 of the x-axis) and after ageing without a metal catalyst (point 1 on the x-axis), in the presence of a metal catalyst (point 2 on the x-axis) and on Kraft paper (point 3 on the x-axis);

FIG. 4: the tan δ of the naphthenic oil (curve A), the oil according to the invention (curve B) and the oil containing 20% silicone oil (curve C), before ageing (point 0 on the x-axis) and after ageing without a metal catalyst (point 1 on the x-axis), in the presence of the metal catalyst (point 2 on the x-axis) and on Kraft paper (point 3 of the x-axis); and FIG. 5: the charge density, expressed in $\mu C/m^3$ and in absolute value, of the naphthenic oil (point 1 on the x-axis), the synthetic ester oil (point 2 on the x-axis), the oil according to the invention (point 3 on the x-axis) and the oil containing 20% silicone oil (point 4 on the x-axis) before and after filtration on the glass frit.

These figures show that:

1. The oil according to the invention has a viscosity almost identical to that of the naphthenic oil that it contains, over the entire temperature range studied. The oil containing 20% silicone oil has a viscosity which is, admittedly, lower at low temperatures but is higher at the usual operating temperatures of power transformers (80-90° C.).
2. Of the three oils tested, the oil according to the invention is the one having the most advantageous dielectric strength properties, with mean breakdown voltage values and a safety factor that are markedly higher than those obtained in the case of the naphthenic oil and the oil containing 20% silicone.

The safety factor is in fact 86 kV in the case of the oil according to the invention (for a water content of 66 ppm and a particulate contamination of 5), whereas it is only 50 kV in the case of the naphthenic oil (for a water content of 10 ppm and a particulate contamination of 6) and of 72 kV in the case of the oil containing 20% silicone oil (for a water content of 12 ppm and a particulate contamination of 5).

This may be explained by the fact that the breakdown resistance depends strongly on the water content of an oil and that, in the case of the synthetic ester oils, the solubility of water in the oil is much higher than in the case of mineral oils.

3. Of the three oils tested, the oil according to the invention is also the one with the most advantageous ageing resistance, its acidity and its tan δ increasing less under the ageing situation than those of the naphthenic oil and the oil containing 20% silicone oil.
4. The oil according to the invention has a higher tendency to become electrically charged than that of the naphthenic oil that it contains or that of the oil containing 20% silicone oil, this being so whatever its water content. However, the charge density values obtained in the case of the oil according to the invention remain perfectly compatible with use as an electrical insulant in power transformers, and are substantially lower than in the case of the synthetic ester oil alone.

The invention claimed is:

1. Dielectric oil comprising a naphthenic oil and an ester oil, wherein the ester oil is a pentaerythritol tetraester of formula (I):

(I)

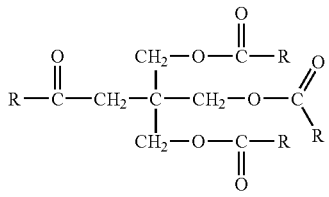

wherein R are independently $C_5H_{11}$ to $C_9H_{19}$ alkyl groups, and wherein the naphthenic oil/ester oil volume ratio is 75/25 to 95/5.

2. Dielectric oil according to claim 1, in which the naphthenic oil is an oil or a mixture of oils that has(have) an aromatic carbon content of approximately 10 to 15%, a paraffinic carbon content of approximately 40 to 45% and a naphthenic carbon content of approximately 45 to 50%.

3. Dielectric oil according to claim 1, which comprises a naphthenic oil having an aromatic carbon content of approximately 14%, a paraffinic carbon content of approximately 41% and a naphthenic carbon content of approximately 45%, and an oil based on pentaerythritol tetraester of formula (I).

4. Dielectric oil according to claim 1, in which the naphthenic oil/ester oil volume ratio is 75/25 to 85/15.

5. Dielectric oil according to claim 1, in which the naphthenic oil/ester oil volume ratio is approximately 80/20.

6. The dielectric oil according to claim 1, having a breakdown voltage according to IEC 60156 of 85-95 kV at a cumulative Gaussian probability of up to 0.3 according to Baur dieltest measurements at 100 kV/50 hz on 32 specimens analyzed by the Laplace-Gauss law.

7. A method for increasing the aging resistance of a dielectric oil which comprises a naphthenic oil, said method comprising:

mixing a synthetic ester oil with the dielectric oil to form a dielectric oil having increased aging resistance, wherein the synthetic ester oil is a pentaerythritol tetraester oil of formula (I):

(I)

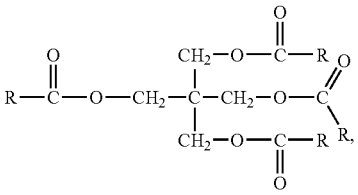

wherein R are independently $C_5H^{11}$ to $C_9H_{19}$ alkyl groups, and wherein the naphthenic oil/synthetic ester oil volume ratio in the dielectric oil having increased aging resistance is 75/25-95/5.

8. The method according to claim 7, wherein the naphthenic oil is an oil or a mixture of oils having an aromatic carbon content of 10-15%, a paraffinic carbon content of 40-45% and a naphthenic carbon content of 45-50%.

9. The method according to claim 7, wherein the naphthenic oil has an aromatic carbon content of 14%, a paraffinic carbon content of 41% and a naphthenic carbon content of 45%.

10. The method according to claim 7, wherein the naphthenic oil/synthetic ester oil volume ratio is 75/25-85/15.

11. The method according to claim 7, wherein the naphthenic oil/polyester oil volume ratio is about 80/20.

12. The method according to claim 7, further comprising: adding the dielectric oil to a high-voltage electrical equipment.

13. The method according to claim 12, wherein the electrical equipment is a power transformer, a measurement equipment, a distribution transformer, a traction transformer, and a power transformer.

14. The method according to claim 7, wherein the mixing forms a dielectric oil having a breakdown voltage according to IEC 60156 of 85-95 kV at a cumulative Gaussian probability of up to 0.3 according to Baur dieltest measurements at 100 kV/50 hz on 32 specimens analyzed by the Laplace-Gauss law.

* * * * *